US006349752B1

(12) United States Patent
Roberts, Jr.

(10) Patent No.: US 6,349,752 B1
(45) Date of Patent: Feb. 26, 2002

(54) MULTI-FUEL KICK BACK RECEIVER

(76) Inventor: John Harold Roberts, Jr., 138 Johnstone La., Georgetown, SC (US) 29440

( * ) Notice: Subject to any disclaimer, the term of this patent is extended or adjusted under 35 U.S.C. 154(b) by 0 days.

(21) Appl. No.: 09/531,306

(22) Filed: Mar. 20, 2000

Related U.S. Application Data

(60) Provisional application No. 60/124,913, filed on Mar. 19, 1999.

(51) Int. Cl.[7] ..... B65B 1/04
(52) U.S. Cl. ..... 141/98; 141/311 A; 141/86
(58) Field of Search ..... 141/86, 311 A, 141/169, 98, 312

(56) References Cited

U.S. PATENT DOCUMENTS

| | | | | | |
|---|---|---|---|---|---|
| 1,000,150 | A | * | 8/1911 | Byrd | |
| 3,871,401 | A | * | 3/1975 | Lyons | 141/86 |
| 4,013,105 | A | * | 3/1977 | Uuskallio | 141/86 |
| 4,338,983 | A | * | 7/1982 | Hatcher | 141/331 |
| 5,277,234 | A | * | 1/1994 | Warstler | 141/331 |
| 5,549,227 | A | * | 8/1996 | Klotz | 141/331 |
| 5,566,731 | A | * | 10/1996 | Holland | 141/86 |
| 5,571,249 | A | * | 11/1996 | Boylen | 141/86 |
| 5,590,698 | A | * | 1/1997 | Whitley et al. | 141/98 |
| 5,662,149 | A | * | 9/1997 | Armellino | 141/98 |
| 5,692,547 | A | * | 12/1997 | Lehr | 141/86 |
| 5,762,114 | A | * | 6/1998 | Petersen | 141/311 A |
| 5,899,249 | A | * | 5/1999 | Armellino | 141/98 |

FOREIGN PATENT DOCUMENTS

| | | | |
|---|---|---|---|
| JP | 6216830 | * | 1/1987 |

* cited by examiner

*Primary Examiner*—Gregory L. Huson
*Assistant Examiner*—Khoa Huynh

(57) ABSTRACT

A device for the retention of multi-fuels which may be built in or used in a portable mode. It will seal at the top of the fuel fillpipe and allow for the insertion of a utility hose nozzle into the top of the fuel fillpipe. When fluid comes out of the fillpipe, it will be contained by deflection shields while still allowing air to escape due to the arrangement of the shields and basin.

1 Claim, 3 Drawing Sheets

MULTI-FUEL KICK BACK RECEIVER

This appln claims benefit of Prov. No. 60/124,913 filed Mar. 19, 1999.

BACKGROUND OF THE INVENTION

The present invention relates to the filling of air-vented tanks with mechanical pumps that can deliver up and beyond 65 gallons per minute and containment of these fluids at the fill pipe when they overflow or sporadically erupt without suppressing these systems which are not designed to be pressurized, it will also contain the fuel air vent over flow. Most of the existing systems in use today are what I will call a free flow system in that it will take on fluids in a natural gravity feed method and as the fluid rises in the tank, air will escape out of the tank's air vent or the fill pipe. This method of filling tanks with fluids has been around for centuries, virtually unchanging the ocurrences of overflow and fluid vent discharges. As time has passed and our knowledge broadened, we have become aware of the need to conserve our natural resources and contain the ones that contaminate our environment. If you cannot see the fluid come out of the air vent or move up the fill pipe, you do not know if the tank is full. As time has passed, our delivery systems allow more and more gallons per minute. This adds to the problem because the more gallons per minute, the more pressure that will be exerted on the kick back. To stop this by pure suppression on present marine vessels would in time blow lines or even worse, blow a fuel tank.

We must keep in mind that many of today's large vessels are built around the fuel tank. A ruptured tank could result in the need to cut the side of the vessel out, causing major construction and cost. Prior art has been introduced by Gary Armellino. The method of redirection and suppression may work fine at a low GPM rate but if it is capable of suppressing that well with this method, the back pressure on the system will weaken the fuel lines or the fuel tanks. Fuel leaks within the hull of a vessel are totally unacceptable. This method of suppression would promote eventual leaking of fuel within the hull. The prior art introduced by Witley does not take into consideration an allowance for violent kick back of fuel out of the fillpipe during the fueling process. There are times when fuel can come out of the fuel pipe and go several feet into the air. This unit would not allow this occurrence.

BRIEF SUMMARY OF THE INVENTION

The present invention relates to the containment of fluids that are pumped by a mechanical means into a holding tank through a fillpipe.

The invention has a set of deflection shields to contain eruptions and a large air breather to alleviate the problem of back pressure. There is also a sink basin so that occasional overflows and eruptions will drain back into the fillpipe if the tank is not yet full. The unit may be set up to be built in or used as a portable device.

BRIEF DESCRIPTION OF THE DRAWINGS

FIG. 3 is a particularly exploded view of the multi-fuel kick back receiver arranged to be permanently built in.

FIG. 5 is an overhead view of the multi-fuel kick back receiver's sink basin to be built in.

FIG. 6 is an overhead view of the multi-fuel kick back receiver arranged to be built in.

DETAILED DESCRIPTION OF THE DRAWINGS

Figure 1:
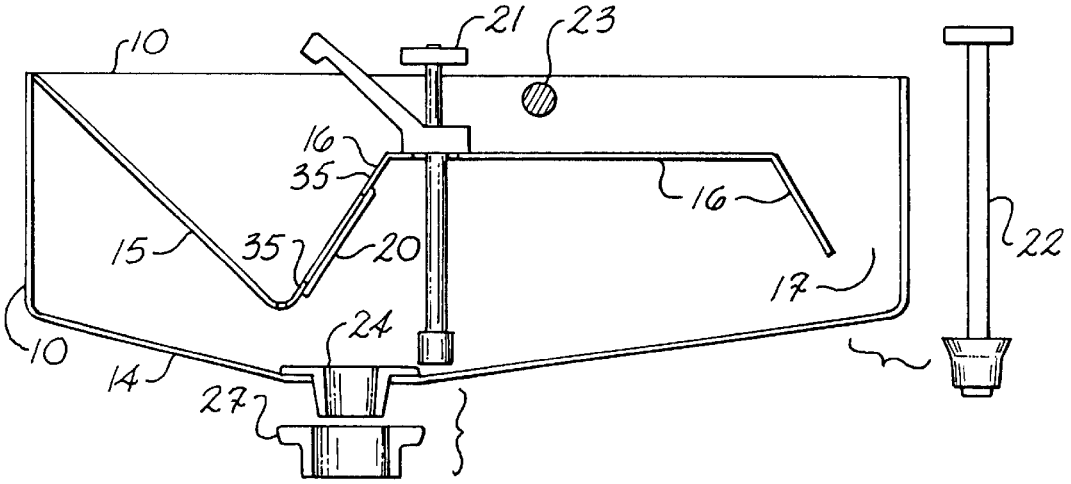
FIG. 1 is a side cutaway view of the multi-fuel kick back receiver arranged for portable use with its accessories.

In FIG. 1, the portable multi-fuel kick back receiver 10 is a fluid containment system that will allow fluid to exit the fueling system as they were designed without applying pressure back on the system. This can be accomplished by placing the pump handle nozzel in the flexible through access 20 and shields on down through the sink basin 24. At this time, the pump handle will be lying on the pump handle bed 15. The pump attendant at this time with one hand on the multi-fuel kick back receiver's 10 handle 23 and the other hand on the pump handle will lift the unit and push the pump handle forward and down. When the pump handle is properly seated the pump handle nozzle should be seen protruding through and out of the bottom of the sink basin drain 24. At this time, he two separate units will feel and operate as one giving the pump attendant a full range of motion.

In FIG. 1 the pump attendant places the pump handle nozzel and the unit as one into the fillpipe opening. As the unit goes down into the fillpipe, the flexible seal 27 which is around the sink basin drain 24 will give fluid a tight seal. At this time we pump the desired fluid. As we pump out fluid at 50 gallons per minute, there is a sudden eruption of fluid up and out of the fillpipe and through the sink basin 24 and straight up into the deflection shields 16. We can see this because the deflection shield 16 which has the through access shield 20 glued to it in an area which is semi-transparent 35. There will be no back pressure because of the air breather 17 on the farend of the unit. When the eruption is over, the fluid will fall into the fluid sink basin 14 which has inclines from the ends down to the sink basin drain 24. The fluid will flow down the sink basin drain 24 and back into the holding tank that we are filling. If the tank is full, we may pump the extra fluid out with the hand pump accessory 22. The unit may also be equipped with a hand stopper accessory 22. In this case, you would press the stopper in place and remove the stopper when you get to an area with adequate holding capacity.

Figure 2:
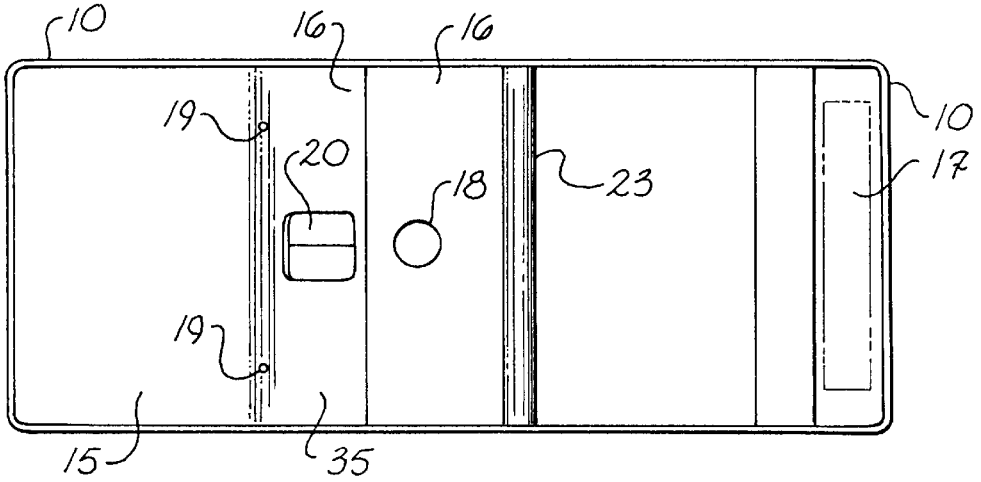
FIG. 2 is an overhead view of the multi-fuel kick back receiver arranged for portable use less its accessories.

FIG. 2. During a violent eruption, should some of the fluid get through the flexible through access shields 20, it will drain back through the pump handle bed drains 19. The accessory attachment hole 18 is located over the sink basin drain 24.

Figure 3:
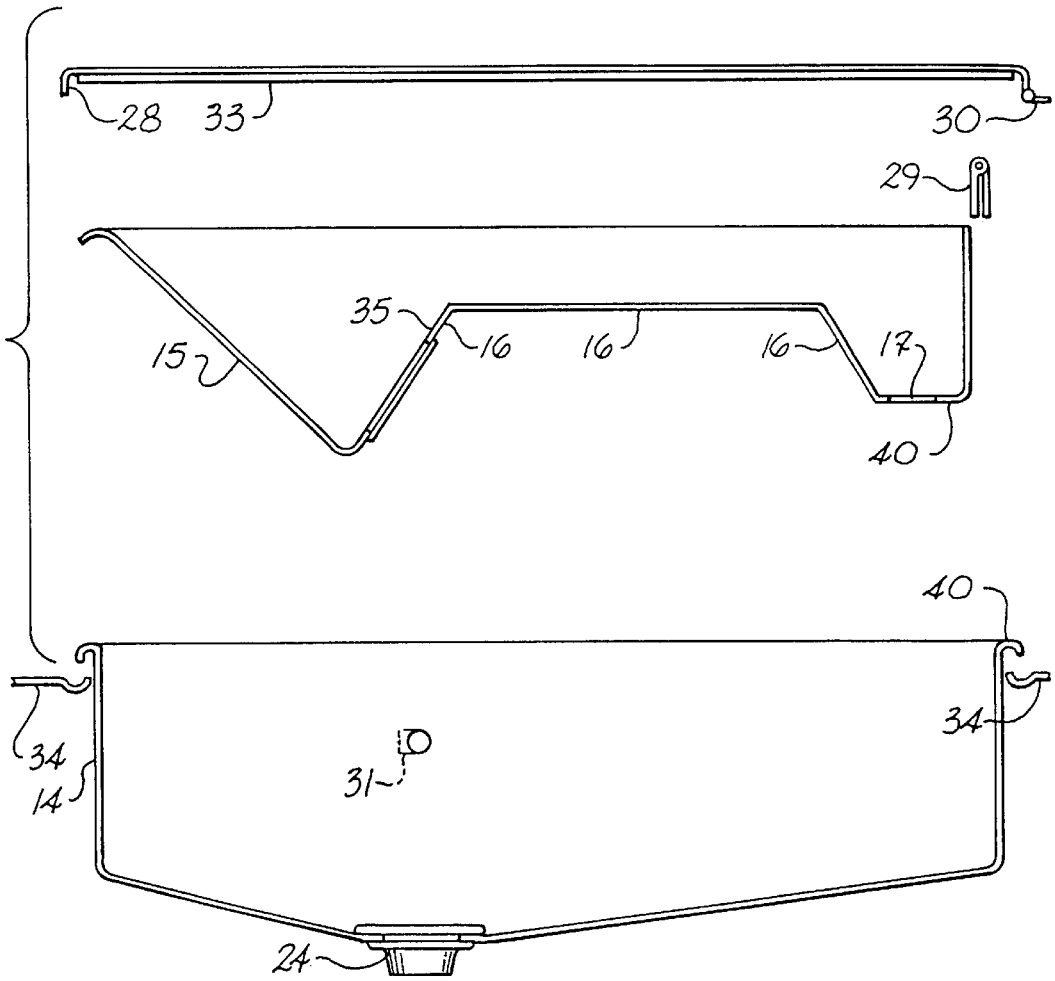

FIG. 3. The multi-fuel kick back receiver built-in 40 will function in the same manner but when built in, there is an added advantage. The holding tank air vent line which is usually vented to the outside environment can now be connected to the multi-fuel kick back receiver's 40 own holding tank air vent connection 31. The advantage to this is when fluid expels out of the holding tank air vent, it will be within the multi-fuel kick back receiver 40 and not into the outside environment. When fluid comes out of the holding tank air vent connection 31, it will hit the semi-transparent area 35 on the deflection shield 16. This unit will be hinged 29 at the end with the air breather. There will also be a generic top 28 with a seal 33 on the bottom of the top 28. This is to keep out debris and water when not in use. There will also be a hinge 30 on top that will be fixed to a permanent mounting surface 34. The sink basin drain 24 will be the point of connection for the fillpipe with a hose clamp or whatever would be standard for the particular application.

Figure 4:
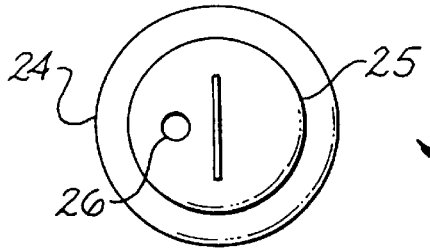
FIG. 4 is an overhead view of the multi-fuel kick back receiver's drain and drain cap.

FIG. 4. The sink basin drain 24 with the built-in unit 40 will have a drain cap 25 and it in turn will have a drain cap

26. The reason for this is that when the unit 40 is mounted to a mode of transportation extreme sloshing may occur. The cap 25 will restrict this greatly but, on the other hand, when a holding tank in a yacht, for example, is full, the vessel is put in forward motion and fuel will come out of the air vent. This is why the drain cap has a drain 26 in it. Otherwide, the multi-fuel kick back receiver could overflow in extreme sea conditions.

Figure 5:
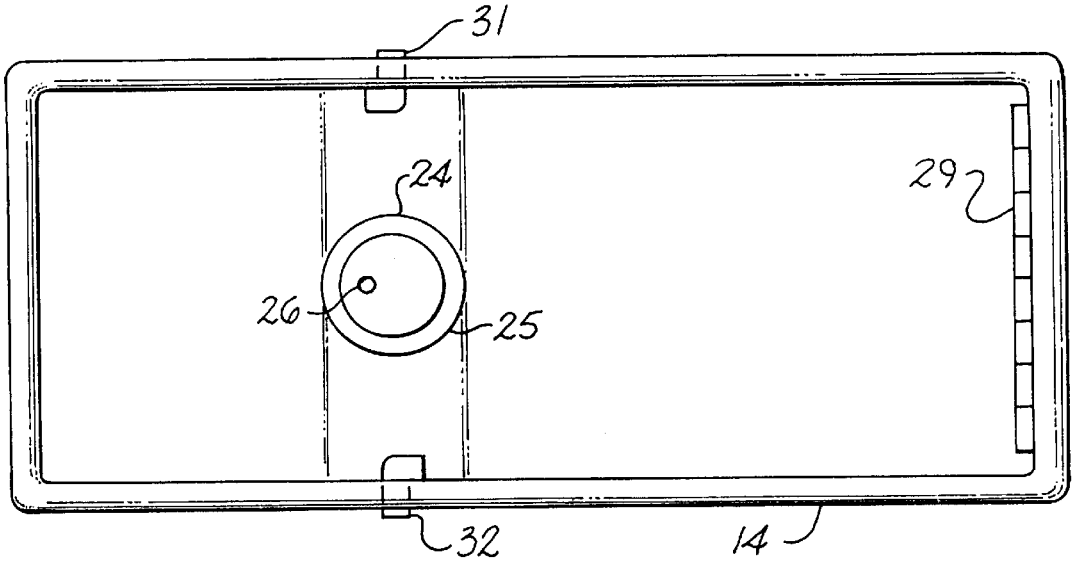

FIG. 5. The fluid sink basin 14 will have the holding tank air vent connection 31 on one side and there will be an external air vent connection 32 on the other side. This vent must be present to allow air into the fuel tank to assure a proper fuel feed to the engine.

Figure 6:
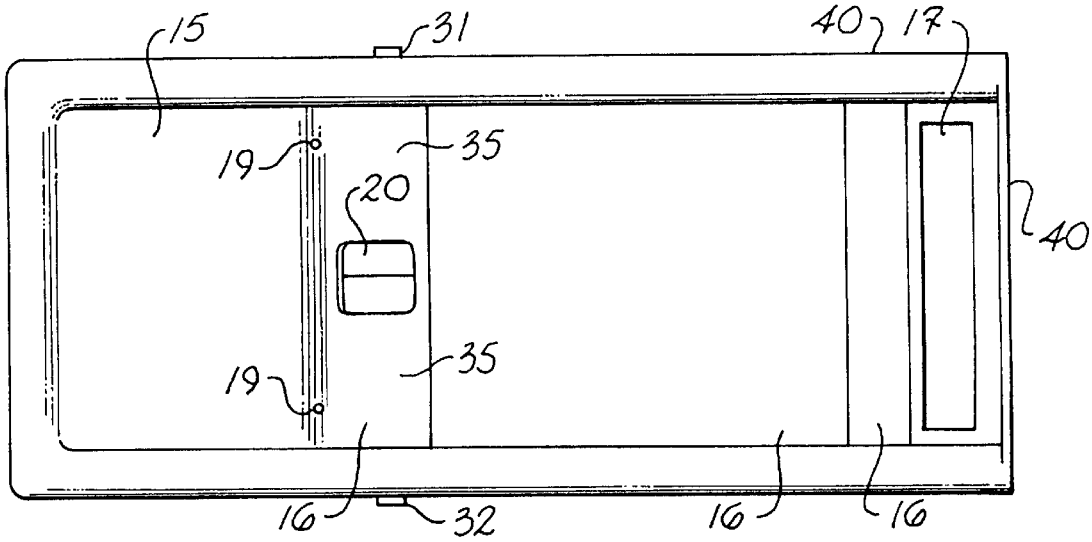

FIG. 6 is an overhead view of the multi-fuel kick back receiver 40, ready to be mounted into place less the top assembly 28, 30 and 33. This is made in fiber glass with marine vessels in mind but it could be made out of metal or plastic and for the containment of any type fluids and may be used with any type holding tank with round hollow fillpipe, mobile or fixed.

Objects of the Invention

10. Multi-fuel Kick Back Receiver as a portable
14. Fluid Sink Basin
15. Pump Handle Bed
16. Deflection Sheild
17. Air Breather
18. Accessory Attachment Hole
19. Pump Handle Bed Drains
20. Flexible Through Access Shields
21. Hand Pump Accessory
22. Hand Stopper Accessory
23. Handle
24. Drain, Sink Basin
25. Drain Cap
26. Drain Cap Drain
27. Flexible Seal For Drain
28. Generic Top
29. Basin Hinge
30. Top Hinge
31. Holding Tank Air Vent Connection
32. External Air Vent Connection
33. Generic Top Seal
34. Permanent Mounting Surface
35. Semi-Transparent Area
40. Multi-fuel Kick Back Receiver built in.

What is claimed is:

1. A fluid overflow and kick-back containment device adapted to be used with a mechanical fluid pump for filling a tank, said tank having a fillpipe and an air vent outlet comprising:

a sink basin having sides, an open top and an inwardly downward-sloped bottom, a drain outlet disposed in said bottom of the sink basin, said drain outlet, in a portable design, having a seal or, in a built-in design, having a fillpipe attachment adapted to be attached to the fillpipe of the tank, a first air vent connection disposed on the sink basin for connecting to the air vent outlet of the tank, a second air vent for allowing air to be released out of the tank, a deflection shield for deflecting fluid that erupts out of the fillpipe, said deflection shield is hingedly mounted on the open top of the sink basin, said deflection shield further having a pump handle bed on one end and an air breather on an opposite end thereof, said pump handle bed extending downwardly toward the bottom of the sink basin and adjacent to the drain outlet, a flexible opening disposed on the pump handle bed and adjacent to the drain outlet, said flexible opening is adapted to be inserted with a nozzle of the mechanical pump, said nozzle protrudes through the opening and the drain outlet for filling the tank, and a drain cap disposed on top of the drain outlet, said drain cap further having a small drain hole for draining fluid that is expelled out of the air vent outlet of the tank and into the sink basin.

* * * * *